US006119439A

United States Patent [19]

Stevie

[11] Patent Number: 6,119,439

[45] Date of Patent: Sep. 19, 2000

[54] NON-CONTACT ROTARY KNIFE PERFORATOR

[75] Inventor: John W. Stevie, Taylor Mill, Ky.

[73] Assignee: R. A. Jones & Co. Inc.

[21] Appl. No.: 09/229,000

[22] Filed: Jan. 12, 1999

[51] Int. Cl.[7] ..... B65B 43/04

[52] U.S. Cl. ..... 53/455; 53/562; 83/945; 83/343; 83/300; 83/678

[58] Field of Search ..... 53/550, 551, 562, 53/568, 455; 83/945, 343, 300, 301, 678

[56] References Cited

U.S. PATENT DOCUMENTS

| | | | |
|---|---|---|---|
| 3,590,695 | 7/1971 | Gerard | 83/678 |
| 4,635,316 | 1/1987 | Towne et al. | 83/678 |
| 5,211,711 | 5/1993 | Marco | 83/300 |
| 5,222,422 | 6/1993 | Benner et al. | 83/345 |
| 5,313,863 | 5/1994 | Aihara et al. | 83/678 |
| 5,722,215 | 3/1998 | Yuyama | 53/562 |
| 5,845,463 | 12/1998 | Henaux | 53/550 |

*Primary Examiner*—Linda Johnson
*Attorney, Agent, or Firm*—Wood, Herron & Evans, LLP

[57] ABSTRACT

A non-contact rotary knife apparatus which perforates a seal area between two adjacent pouches in a continuous web by using perforating blades, preferably on the minor hub, and anvils on the major hub with the anvils having elongated, spaced apart recesses for receiving but not touching the teeth of the perforating blade. Thus, a major knife hub is mounted for rotation and has perforating anvils spaced about the exterior of the major knife hub. Each of the perforating anvils has elongated, spaced-apart recesses. A minor knife hub is also mounted for rotation proximate to the major knife hub and has perforating blades spaced about the exterior of the minor knife hub. Each of the perforating blades has an edge with spaced perforating teeth disposed along the edge. The teeth are adapted to operably mesh with but not contact the elongated recesses of the perforating anvils when the major and minor knife hubs are rotated thereby producing a line of perforations in a seal area between adjacent pouches in a continuous web passing between respective areas of the perforating blades and the perforating anvils.

12 Claims, 3 Drawing Sheets

NON-CONTACT ROTARY KNIFE PERFORATOR

FIELD OF THE INVENTION

This invention relates to pouch machines and, more specifically, to a perforation apparatus for producing a line of perforations in the vertical seal between selected filled pouches in a continuous web.

BACKGROUND OF THE INVENTION

In typical pouch machines, a flat web of heat sealable material is continuously f ed from upstream of the pouch machine and is longitudinally folded upon itself by a plow or similar device. The thus-folded web is fed about a sealer which contacts the folded web along vertical heated land areas to form transverse vertical seals, and, thus, a series of open-top pouches along the web. The web of open-top pouches is passed around a filler wheel, filled with product and then sealed along the top edge of the web. The web of filled pouches then passes downstream to a motor-driven knife or rotary perforation apparatus which cuts the pouches apart or perforates the transverse vertical seal between two adjacent pouches in the web. The perforations allow the pouches to remain part of the continuous web, but facilitate the later separation from the web preferably along the perforations.

In one prior perforation apparatus, a major knife hub has a plurality of knife blades interacting with a plurality of notched knife blades of a minor hub to perforate the vertical seals between adjacent pouches in the web. More specifically, a notched knife blade on the minor hub contacts or interferes with a knife blade on the major hub to create perforations in a pattern copasetic with the notches in the knife blade. Depending on the notch configuration of the blade, the perforations are generally primitive and course, requiring special care when separating the pouches from the web along the perforations in order to avoid tearing into one of the pouches and exposing its contents. For example, when pulling such pouches apart, it is easy for a tear or crack to start at the corners of the perforations and readily extend into the unsealed pouch material, opening the pouch, rather than extending along the perforation line for pouch separation. These unwanted tears or cracks occur in part where the perforations are wide in the machine direction. To avoid unnecessary tearing into the pouches when trying to separate the pouches along the course perforations, some manufactures now avoid the perforation step completely, telling their customers to separate adjacent pouches with scissors or knife devices instead. Using scissors to separate the pouches from the web adds an extra step for the customer, making the product less desirable from a handling standpoint.

This prior perforation device has other disadvantages. For instance, because the blades must create an interference contact to create the perforations, the blades wear out quickly, greatly reducing the life of the blade. Additionally, the blades must be synchronized relatively precisely in order to properly form the perforations. For instance, if the blades are not synchronized, then the perforation may be incomplete or less desirably one of the blades may contact the pouch, tearing it open and exposing its contents. Moreover, unsynchronized blades may tear the web, requiring that the production line be stopped so that the web may be rethreaded through the perforation apparatus. The synchronization is even more difficult to achieve where there is a chord difference between the minor perforating blades on the one hub and the major hub blades on the other. The chord dimension or set-up usually varies within the ratio of about 1.0 to about 0.93 and this variation leads to tearing of the perforations during the perforation operation and undue widening of the perforation holes in the machine direction. Another difficultly experienced with prior perforating operations is the cut lengths are generally significantly larger than the secure bridges between the pouches. This severely weakens the lines of the perforation and may cause premature separation during pouch train handling.

Accordingly, one objective of this invention is to provide an improved rotary knife perforator for improving the perforation in the vertical seal between two adjacent pouches in a continuous web.

Another object of this invention is to provide an improved rotary knife perforator for creating a perforation with a refined appearance that makes separation of the pouches from the web easy and repeatable.

Another object of this invention is to provide an improved rotary knife perforator that eliminates interference contact between the blades thereby minimizing blade wear.

Still another object of this invention is to provide a non-contact rotary knife perforator that minimizes the need to synchronize respective blade edges, but still eliminates tearing of the web by the blades.

SUMMARY OF THE INVENTION

These and other objects of the invention are provided for by a non-contact rotary knife apparatus which perforates a seal area between two adjacent pouches in a continuous web by using perforating blades, preferably on the minor hub, and anvils on the major hub with the anvils having elongated, spaced apart recesses for receiving but not touching the teeth of the perforating blade. The anvil recesses are defined in part by flat-topped areas intermediate each recess for supporting the web as the perforating blade extends therethrough. The anvil is preferably elongated or wide in the machine direction. This configuration provides a range over which the perforating blade can interface with the anvil and thus an adjustment range so that the perforating blades can be adjusted to a dynamic or relative velocity ratio of about 1:1 with respect to the anvil, thus decreasing tearing. To that end, the packaging guides on the major hub are adjustable, eliminating unwanted web tearing by the blade.

The perforations so formed are small and numerous. Since the perforating blade pierces only one side, all paper or pouch material at the perforations is pushed through leaving on one side a nice finished appearance. Since numerous material bridges are left the pouch-to-pouch bond is still strong and the pouch train easily remains intact, yet the pouches are easily separated from the train without undue tearing away from the line of perforations.

In accordance with the principles of the invention a major knife hub is mounted for rotation and has perforating anvils spaced about the exterior of the major knife hub. Advantageously, the major knife hub further includes a plurality of suction ends spaced about the major hub and facing radially outwardly. The suction ends are adapted to hold the web about the major hub as the web is being perforated. Each of the perforating anvils has elongated, spaced-apart recesses. Preferably, the perforating anvils have flat-topped areas spaced across the perforating anvils for supporting the web as the perforating blade extends through the seal area between adjacent pouches. A minor knife hub is also mounted for rotation proximate to the major knife hub and has perforating blades spaced about the exterior of the minor knife hub. Each of the perforating blades has an edge with spaced perforating teeth disposed along the edge. The teeth are adapted to operably mesh with but not contact the elongated recesses of the perforating anvils when the major and minor knife hubs are rotated thereby producing a line of perforations in a seal area between adjacent pouches in a continuous web passing between respective areas of the perforating blades and the perforating anvils. Preferably, the line of perforations in the seal area is linear and oriented perpendicular to the movement of the continuous web.

Where the perforations are cut between each pouch, a distance taken between an adjacent pair of the perforating blades defines a first chord length and a distance taken between adjacent pairs of the anvils defines a second chord length. In order to produce a well-defined line of perforations, the first chord length is preferably substantially equal to the second chord length. Advantageously, the major knife hub includes a guide member for aligning the incoming web onto the major knife hub and for adjusting the chord between which the lines of perforation are formed. Additionally, a well-defined line of perforations is achieved when the perforating anvils and the perforating blades each have tangential velocities at the point of perforation which are substantially equal. As such, a line of perforations in the seal area between adjacent pouches is generated with a width substantially equal to that of the width of the perforating teeth in the perforating blade.

The invention also contemplates a method of producing a line of perforations in a seal area between two pouches in a web running through a rotary knife. The steps include supporting the web on the perforating anvils carried by the major knife hub. Then rotating the perforating blades into a meshing relation with respect to the perforating anvil to press the perforating teeth through the web from one side only while supporting the other side of the web with the flat-topped areas of the perforating anvils.

In yet another aspect of the invention, it will be appreciated that pouch groups may be cut apart by traditional knives on the major and minor hubs, but a line of perforations is cut between each pouch in the separated group for later separation. For example, by alternating knives on the hubs, successive groups of two pouches each are cut from the web, with a line of perforations cut between the two pouches of each individual group.

DETAILED DESCRIPTION OF THE INVENTION

Figure 1:
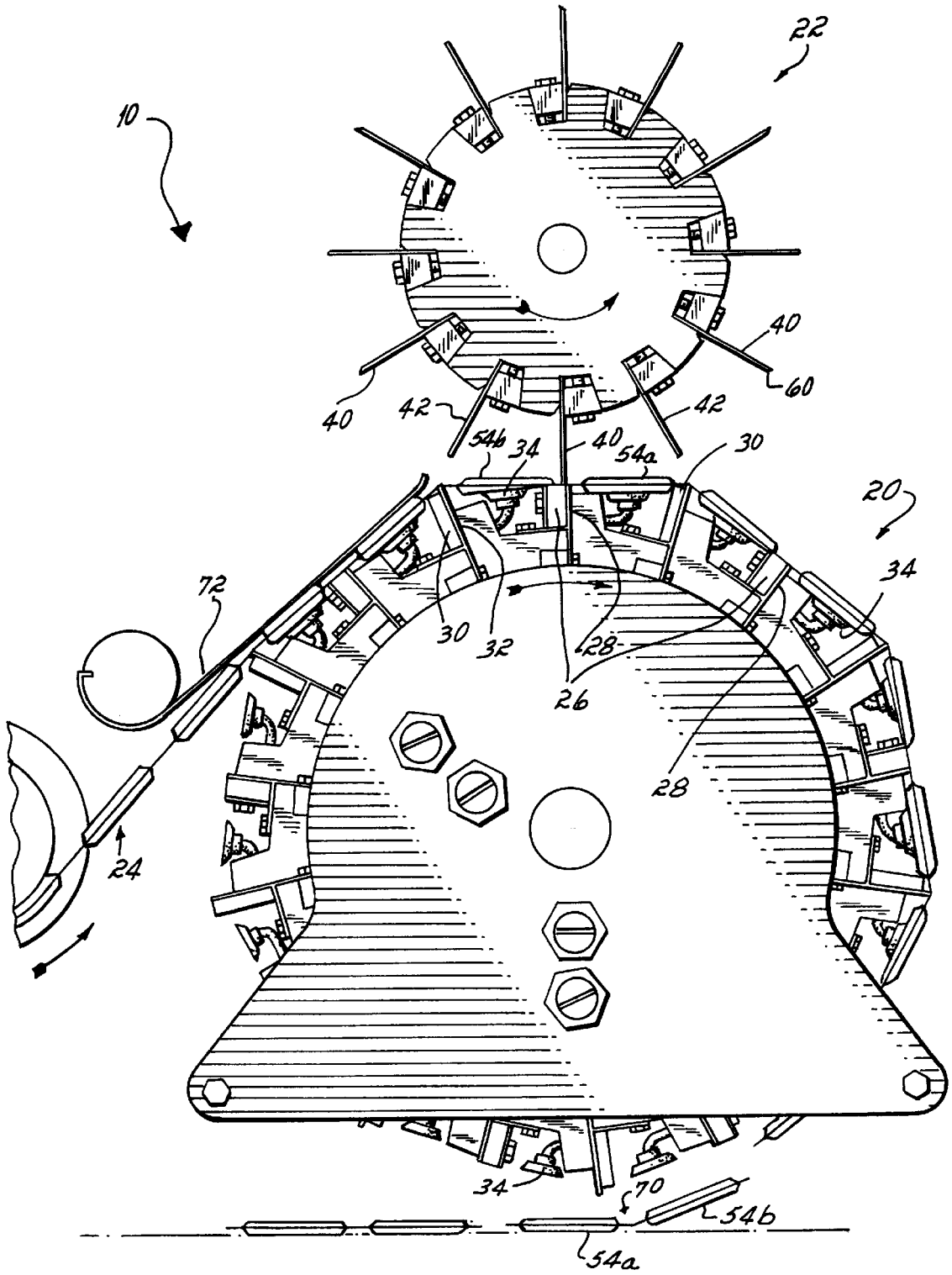
FIG. 1 is an elevational view of the perforation apparatus of the invention.

With reference first to FIG. 1, a perforation apparatus 10 is shown constructed in accordance with the principles of the invention. The perforation apparatus 10 includes a major knife hub 20 and a minor knife hub 22 each mounted for rotation. The major knife hub 20 and the minor knife hub 22 rotate in the direction shown by the arrows on each respective hub. The major knife hub 20 and the minor knife hub 22 are positioned relative to each other such that they cooperate to selectively perforate and shear a continuous web of pouches 24. The web of pouches 24 is produced and supplied to the perforation apparatus 10 by an upstream pouch form, fill, and seal machine (not shown) which is described in greater detail in U.S. Pat. No. 5,829,332, incorporated herein by reference.

The major knife hub 20 has a plurality of perforating anvils 26 mounted on radially extending members 28 spaced about the outer periphery or exterior of the major knife hub 20. The major knife hub 20 also has a plurality of rigid knife blades 30 mounted on radially extending members 32 alternately spaced about the exterior of the major knife hub 20 between the perforating anvils 26. The major knife hub further includes a plurality of pouch retention members 34 facing radially outwardly for holding the web 24 about the major knife hub 20 during the shearing or perforated actions. The pouch retention members 34 are preferably subject to negative or positive pressures selectively applied to hold or drop the web 24 as desired.

The minor knife hub 22 includes a plurality of radially extending perforating blades 40 spaced about the exterior of the minor knife hub 22. The minor knife hub 22 also includes a plurality of radially extending knife blades 42 alternately spaced about the exterior or outer periphery of the minor knife hub 22 between the perforating blades 40. The rotation of the minor knife hub 22 is indexed relative to the rotation of the major knife hub 20 such that an individual perforating blade 40 interacts or cooperates with an individual perforating anvil 26 to produce a line of perforations between two successive pouches in the web 24. Likewise, the rotation of the minor knife hub 22 is indexed relative to the rotation of the major knife hub 20 such that an individual knife blade 42 interacts or cooperates with an individual knife 30 to shear apart or cut into two successive pouches in the web 24.

Figure 2:
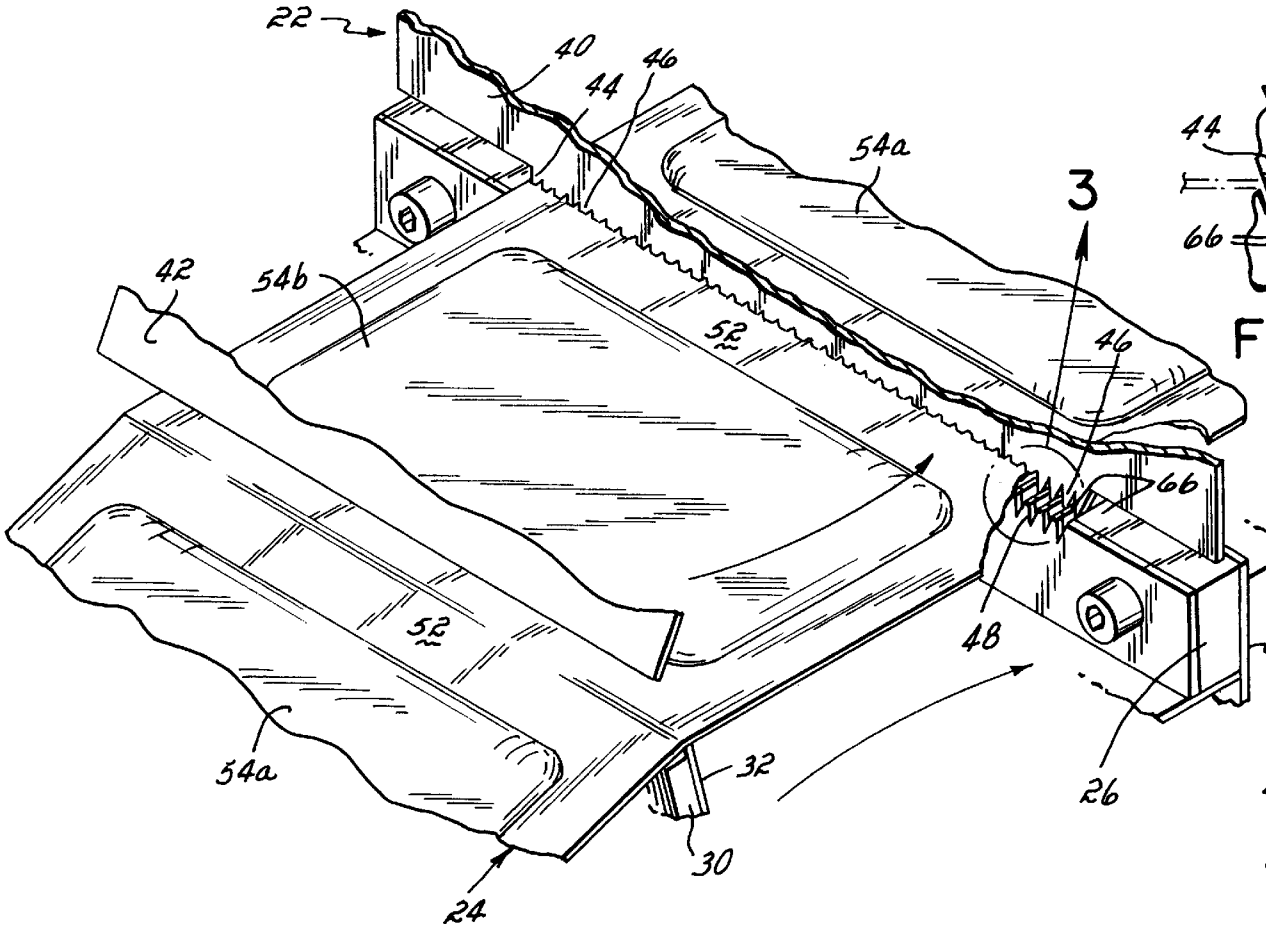
FIG. 2 is an enlarged perspective view illustrating a perforating blade interacting with an anvil of the perforation apparatus of FIG. 1 to create perforations in the sealed area between two successive pouches.

With reference to FIG. 2, the perforating blade 40 has an edge 44 with a plurality of perforating teeth 46 disposed along the edge 44. The perforating anvil 26 has a plurality of elongated, spaced recesses 48 along the outer most portion of the perforating anvil 26. In accordance with the principles of the invention, the teeth 46 mesh with but do not contact the recesses 48 so as to produce a line of perforations 50 in a seal area 52 between adjacent pouches 54*a*, 54*b* in the web 24 passing between the perforating blade 40 and the perforating anvil 26. Preferably, the line of perforations 50 is oriented perpendicular to the movement of the web 24 entering the perforation apparatus 10.

Generally, a perforation line made up of many short, closely-spaced perforation holes is preferable to a perforation line made up of only a few long, widely-spaced perforation holes. To this end, the perforating blade has features necessary to yield a preferred perforation line. As is shown in greater detail in FIGS. 3 and 4, the teeth 46 of the perforating blade 40 are triangular in shape. The lower section of the teeth 46 have a tapered portion 60 which, along with the triangular shape of the teeth 46, defined a substantially sharp and well-defined point 62. This well-defined point 62 and the tapered portion 60 yields a sharply-defined puncture hole in the seal area 52 during the perforation operation. Additionally, the teeth 46 are also closely spaced along the edge 44 of the perforating blade 40 so that a large number of closely-spaced perforation holes 64 (FIG. 5A) form the perforation line 50. As such, the perforation line 50 produced by the perforating blade 40 and the perforating anvil 26 has desirable characteristics not present in a perforation line having longer, widely-spaced perforation holes. For instance, the adjacent pouches 54*a*, 54*b* are easily separated along the perforation line 50 without tearing into the actual filled adjacent pouches 54*a*, 54*b*.

The perforating anvil 26 has a width or thickness W1 in the machine direction, i.e., from the leading edge to the trailing edge of the perforating anvil 26. Preferably, the width W1 is about 0.375 inches. The recesses 48 of perforating anvils 26 have a depth D1. Preferably, the depth D1 is about 0.077 inches. The perforating blade has a thickness W2 in the machine direction. Preferably, the thickness W2 is about 0.060 inches. During a perforation operation the tapered portion 60 extends into the recesses 48 a distance D2. The further the tapered portion 60 extends into the recess 48 the larger the perforation hole 64 that is created. Preferably, the distance D2 is about 0.050 inches.

Figure 3:
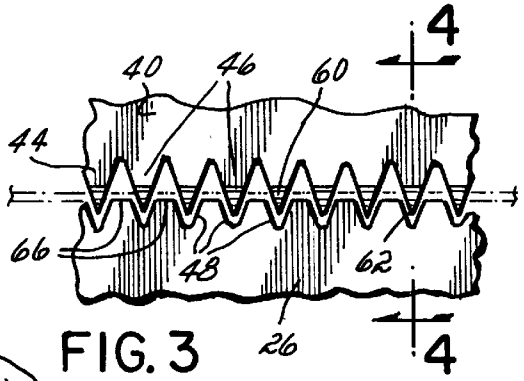
FIG. 3 is enlarged elevational view taken at detail 3 of FIG. 2 illustrating a perforating blade interacting with an anvil.
Figure 4:
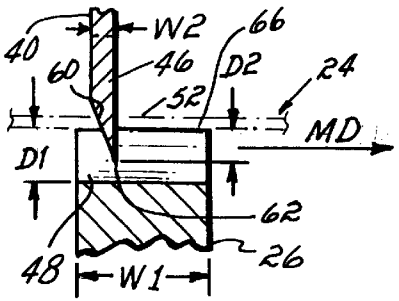
FIG. 4 is a cross-sectional view taken along line 4—4 of FIG. 3.

As shown in FIG. 3, the elongated recesses 48 are triangular in cross-section shape to receive the triangular-shaped perforating teeth 46. However, the recesses 48 have flat-topped areas 66 instead of having the well-defined points 62 of the teeth 46. These flat-topped areas 66 provide support for the web 24 and particularly the seal area 52 as the perforating blade 40 meshes with the perforating anvil 26 to produce the line of perforations 50 in the seal area 52.

Figure 5:
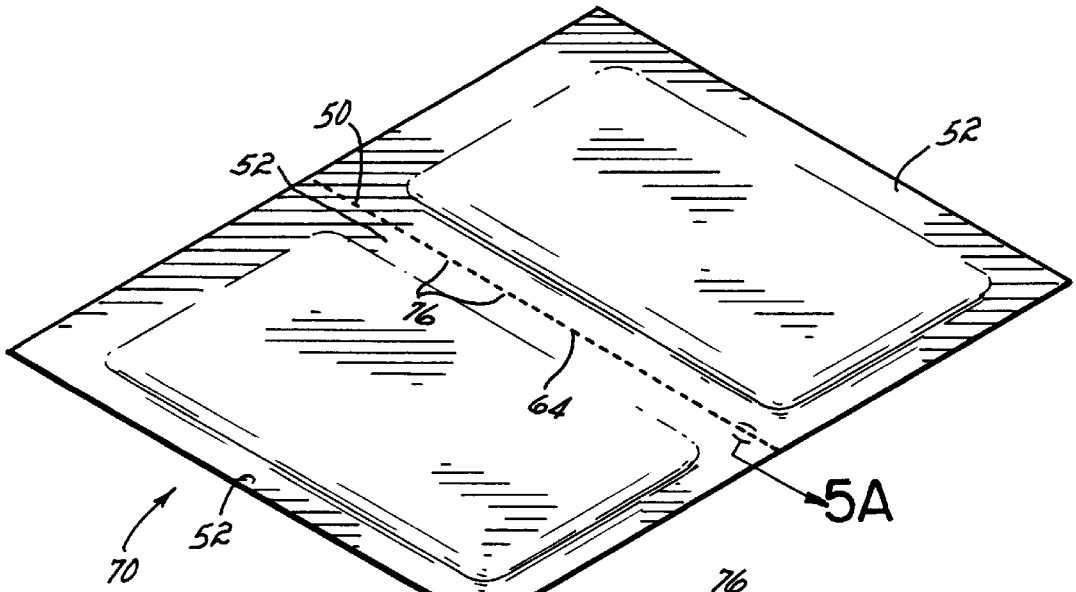
FIG. 5 is an enlarged perspective view of two successive pouches having a line of perforations in the sealed area between the two pouches as generated by the perforation apparatus of FIG. 1.
Figure 5A:
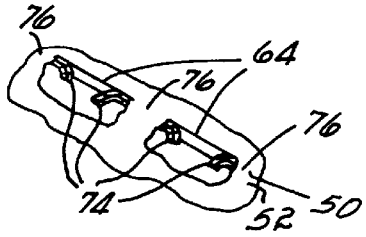
FIG. 5A is an enlarged perspective view of the area 5A of FIG. 5 showing the perforation holes generated by the perforation apparatus of FIG. 1.

In operation and with reference to FIGS. 1, 5 and 5A, the perforation apparatus 10 receives a continuous web of pouches 24 and outputs a series of individual two-pouch units 70, each unit having adjacent pouches 54*a*, 54*b* divided by a line of perforations 50 in the seal area 52. To produce a single two-pouch unit 70, two shearing operations and one perforation operation are performed on the continuous web of pouches 24. More specifically, the continuous web of pouches 24 is directed to and aligned with the outer portion of the major knife hub 20 by guide member 72. The pouch retention members 34 subject the web 24 to a negative pressure or suction to hold the web 24 onto the major knife hub 20. As the major knife hub 20 and the minor knife hub 22 rotate, cooperating pairs of the knife blades 30, 42 shear the seal area 52 between two adjacent pouches so that the two adjacent pouches are separated from one another, constituting the first of the two shearing operations required to form a single two-pouch unit 70. A more detailed explanation of the shearing process used by knife blade 30 and knife blade 42 to separate adjacent pouches is provided in U.S. Pat. No. 5,222,422, which is incorporated herein expressly by reference as showing a prior web cutting knife.

The perforation operation next follows the first shearing operation. After being subjected to the first shearing operation, the web 24 is advanced by the continuous rotation of the major knife hub 20. As such, the perforating blade 40 on the minor knife hub 22 rotates to mesh with but not contact the corresponding perforating anvil 26 which is rotating on the major knife hub 20. As the perforating blade 40 begins to align and cooperate with the perforating anvil 26, the perforating teeth 46 start to puncture perforation holes 64 into the seal area 52 between the adjacent pouches 54*a*, 54*b*. As the rotation of both the major knife hub 20 and the minor knife hub 22 continues, the perforating teeth 46 penetrate further through the seal area 52 and into the recesses 48 in perforating anvil 26. Upon further rotation, the perforating teeth 46 are extracted out of the recesses 48 and the perforation holes 64 are completed. As shown in FIG. 5A, the triangular shaped teeth 46 push the pouch material 74 radially inwardly toward the major knife hub 20, leaving the adjacent perforation holes 64 connected by a bridging member 76 made up of non-perforated pouch material. Consequently, the surface of the line of perforations 50 on the side into which the perforating teeth 46 initially entered is relatively smooth, but the opposite side has raised areas around the perforation holes 64 where the pouch material 74 has been pushed through by the perforating teeth 46.

The second shearing operation follows the perforation operation. The web 24 is advanced further by the major knife hub 20 so that the pouch 54*b* is sheared from the rest of the web of pouches 24 by the next pair of cooperating knife blades 30, 42. The second shearing operation competes the production of a single two-pouch unit 70 which remains secured to the major knife hub 20 by the pouch retention members 32. Upon reaching a desired location, the two-pouch unit 70 is released from the pouch retention members 32 onto a transporting means, preferably a conveyor belt, to carry the two-pouch units 70 to a cartoning or handling station.

The major knife hub 20 and the minor knife hub 22 are indexed so that the perforating blade 40 always cooperates or interacts with perforating anvil 26 to perform a perforation operation and knife blade 40 always cooperates or interacts with knife blade 30 to perform a shearing operation. The rotational speeds and the radial dimensions of the major knife hub 20 and the minor knife hub 22 are selected so that the tangential velocities of the perforating blades 40 and the perforating anvils 26 at the point where the perforations are formed are substantially equivalent. When the tangential velocities are not substantially equivalent, the quality and integrity of the line of perforations 50 is greatly reduced. For instance, if the perforating blade 40 had a sufficiently higher tangential velocity than the perforation anvil 26, the perforating teeth 46 would create unacceptably wide perforation holes 64 and in some instances tear the seal area 52 in the web direction such that the bridging members 76 between adjacent perforation holes 64 ruptures and the adjacent perforation holes form one larger hole. Such wider perforation holes 64 with the noted tearing tends to weaken the connection between the adjacent pouches 54*a*, 54*b* and may lead to unwanted separation of the adjacent pouches 54*a*, 54*b* along the line of perforations 50. When the tangential velocities are substantially equivalent, the perforating teeth 46 produce perforation holes 64 with dimensions substantially equivalent to the perforation teeth 46, i.e., no excessive widening in the machine direction.

The present invention contemplates a method of producing a line of perforations 50 in the seal area 52 between two adjacent pouches 54*a*, 54*b* in a web of pouches 24. The method comprises the steps of supporting the web 24 on the perforating anvils 26 of the major knife hub 20. The perforating anvils 26 have the flat-topped areas 66 facing outwardly from the major knife hub 20 to support the web 24. Next, the perforating blades 40 with their perforating teeth 46 rotate into a meshing relation with respect to the perforating anvils 26 to press the perforating teeth 46 through the web from one side only while supporting the other side of the web with the flat-topped areas 66 of perforating anvils 26. The package guides are adjusted to accommodate the desired pitch or chord of the pouches while maintaining substantially equal relative linear velocities of the operative perforating blades 40 and the perforating anvils 26, the width of the anvils 26 in the machine direction accommodating the adjustment. Accordingly, the operative perforating blades 40 and perforating anvils 26 produce a consistent line of perforations 50 which is not torn by the perforating blades 40.

Accordingly, the invention produces an improved perforating apparatus and methods and an improved finished product in the perforated pouch seals of adjacent pouches. The invention is useful to produce a train of pouches 24, each defined from the other in part by a line of improved perforations 50, or separate groups of pouches with the pouches of each group defined in part by improved perforations. These configurations are provided by merely selecting the positions of knives blades 30, 42 or perforating blades 40.

These and other embodiments and modifications will become readily apparent to those of ordinary skill in the art without departing from the scope of this invention and the applicant intends to be bound only by the claims appended hereto.

What is claimed is:

1. A non-contact rotary knife apparatus for perforating a seal area between two adjacent pouches in a continuous web, the apparatus comprising:

a major knife hub mounted for rotation and having transversely extending perforating anvils spaced about the exterior of said major knife hub, each of said anvils having elongated, spaced-apart recesses; and a minor knife hub mounted for rotation proximate to said major knife hub and having perforating blades spaced about the exterior of said minor knife hub, each of said blades having an edge with spaced perforating teeth disposed transversely therealong, said teeth operably meshing with but not contacting said recesses of said anvils when said hubs are rotated so as to produce a line of perforations in a seal area transversely between adjacent pouches in a continuous web passing between respective areas of said perforating blades and said perforating anvils.

2. The apparatus of claim 1 wherein said recesses of said anvils have flat-topped areas spaced across said anvils for supporting the web as the perforating blade extends therethrough.

3. The apparatus of claim 1 wherein a distance taken between an adjacent pair of said perforating blades defines a first chord length and a distance taken between adjacent pairs of said anvils defines a second chord length, said first chord length being substantially equal to said second chord length.

4. The apparatus of claim 1 wherein said perforating anvils and said perforating blades each have tangential velocities at the point of perforation which are substantially equal so as to generate a perforation in the seal area between adjacent pouches with a width substantially equal to that of the width of said teeth in said perforating blade.

5. The apparatus of claim 1 wherein said perforation in the seal area is linear and oriented perpendicular to the movement of the continuous web.

6. The apparatus of claim 1 wherein the major knife hub further includes a plurality of suction ends spaced about said major hub and facing radially outwardly, said suction ends adapted to hold the web about said major hub as the web is being perforated.

7. The apparatus of claim 1 wherein the major knife hub further includes a guide member for aligning the incoming web onto the said major hub and for adjusting the chord between which the lines of perforation are formed.

8. The apparatus of claim 1 wherein the anvil has leading and trailing edges and a thickness, front to back in the machine direction, of the anvil between said edges is about 0.375 inches.

9. The apparatus of claim 8 wherein said anvil has a support face in which said recesses are defined open outwardly and the spaced teeth of the minor hub move into said recesses in positions spaced intermediate leading and trailing edges of said anvil.

10. A method of producing a line of perforations in a seal area transversely between two pouches in a web running through a rotary knife, comprising the steps of:

supporting said web on transverse anvils carried by a knife hub, each of said anvils having a support face disposed outwardly from said knife hub and having a plurality of longitudinal recesses therein extending transversely thereacross; and rotating perforating blades, each having a plurality of perforating teeth on an edge of the perforating blade for meshing relation with respect to said anvil recesses to press the perforating teeth through the web from one side only while supporting the other side of the web with said anvils.

11. The method of claim 10 further including a plurality of adjustable successive packaging guides and wherein the perforating blades define a chord therebetween and successive packaging guides define a chord therebetween, the method further comprising adjusting the packaging guides to a radial position wherein the length of said chords are substantially equal and wherein said perforating blades intersect said longitudinal anvil recesses when said chords are substantially equal.

12. The method of claim 10 wherein rotating the perforating blades into meshing relation with the recesses does not cause blade contact with the anvil.

* * * * *